US007059284B2

(12) United States Patent
Pecori et al.

(10) Patent No.: US 7,059,284 B2
(45) Date of Patent: Jun. 13, 2006

(54) INTERNAL COMBUSTION ENGINE HAVING VALVES WITH VARIABLE ACTUATION AND HYDRAULIC ACTUATING UNITS WHICH CONTROL THE VALVES BY MEANS OF ROCKER ARMS

(75) Inventors: Andrea Pecori, Turin (IT); Francesco Vattaneo, Pancallieri (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 11/209,958

(22) Filed: Aug. 23, 2005

(65) Prior Publication Data

US 2006/0054118 A1 Mar. 16, 2006

(30) Foreign Application Priority Data

Sep. 14, 2004 (EP) ..... 04425682

(51) Int. Cl.
*F01L 9/02* (2006.01)

(52) U.S. Cl. ..... 123/90.12; 123/90.44; 123/90.45; 123/90.55

(58) Field of Classification Search ..... 123/90.11, 123/90.12, 90.13, 90.16, 90.17, 90.27, 90.31, 123/90.39, 90.44, 90.45, 90.48, 90.52; 251/129.01, 251/129.15

See application file for complete search history.

(56) References Cited

U.S. PATENT DOCUMENTS 6,918,364 B1 * 7/2005 Vattaneo et al. ..... 123/90.55

FOREIGN PATENT DOCUMENTS

| | | |
|---|---|---|
| EP | 0 546 820 A1 | 6/1993 |
| EP | 0 803 642 B1 | 10/1997 |
| EP | 1 091 097 A1 | 4/2001 |
| EP | 1 344 900 A2 | 9/2003 |
| GB | 2 101 255 A | 1/1983 |

OTHER PUBLICATIONS

European Search Report dated Apr. 15, 2005, for European Patent Application No. 04425682.4, filed Sep. 14, 2004.

U.S. Appl. No. 11/190,325, filed Jul. 27, 2005, based upon European Patent Application No. 04425809.3, filed Oct. 28, 2004 entitled "Internal-Combustion Engine Having An Electronically Controlled Hydraulic Device for Variably Actuating Intake Valves"; Applicants: Francesco Vattaneo, Gianluca Canino and Luca Iannarelli, assigned to C.R.F. Società Consortile per Azioni.

* cited by examiner

*Primary Examiner*—Thomas Denion
*Assistant Examiner*—Ching Chang
(74) *Attorney, Agent, or Firm*—Heslin Rothenberg Farley & Mesiti P.C.; Victor A. Cardona, Esq.

(57) ABSTRACT

In an internal combustion engine provided with valves with variable actuation, each variable actuation valve is controlled by a hydraulic actuator unit through a rocker arm.

11 Claims, 4 Drawing Sheets

*"PRIOR ART"*

*"PRIOR ART"*

INTERNAL COMBUSTION ENGINE HAVING VALVES WITH VARIABLE ACTUATION AND HYDRAULIC ACTUATING UNITS WHICH CONTROL THE VALVES BY MEANS OF ROCKER ARMS

CROSS REFERENCE TO RELATED APPLICATIONS

This application is a claims priority from European patent application No. 04425682.4, filed on 14 Sep. 2004, the entire disclosure of which is incorporated herein by reference.

BACKGROUND OF THE INVENTION

The present invention relates to internal combustion engines with multiple cylinders, of the type comprising:

at least one intake valve and at least one exhaust valve for each cylinder, each provided with respective elastic return means which bias the valve towards a closed position, to control respective intake and exhaust conduits, at least one camshaft, to actuate the intake and exhaust valves of the engine cylinders by means of respective tappets, in which at least each intake valve has variable actuation, being actuated by the respective tappet, against the action of the aforesaid elastic return means, by the interposition of hydraulic means including a pressurised fluid chamber, into which projects a pumping piston connected to the tappet of the intake valve, said pressurised fluid chamber being able to be connected by means of a solenoid valve with an exhaust channel, in order to uncouple the variable actuation valve from the respective tappet and cause the rapid closure of the valve by effect of the respective elastic return means, electronic control means for controlling each solenoid valve in such a way as to vary the time and travel of opening of the variable actuation valve as a function of one or more operative parameters of the engine, in which the aforesaid hydraulic means further comprise an actuator unit for the variable actuation valve, which includes:

an actuating piston slidably mounted within a guide bushing, said actuating piston facing a variable volume chamber communicating with the pressurised fluid chamber both through first communication means controlled by a check valve which allows only the passage of the fluid from the pressurised fluid chamber to the variable volume chamber, and through second communication means which allow the passage between the two chambers in both directions, and hydraulic braking means able to cause a narrowing of said second communication means in the final phase of closure of the engine valve.

An engine of the type specified above is described and illustrated for example in European patent application 1 344 900 A2 by the same Applicant.

In engines of this kind, it is very difficult to arrange all the elements of the variable valve control system without thereby increasing the size of the cylinder head with respect to a traditional engine.

SUMMARY OF THE INVENTION

The object of the present invention is to conceive an engine of the type indicated above which instead allows the designer ample freedom in choosing the arrangement of the various parts of the valve control system, in particular with the intention of minimising the overall size of the engine.

In view of achieving this object, the present invention relates to an engine of the type indicated at the start of the present description, having the characteristics set out in the accompanying claim 1. Additional preferred and advantageous characteristics of the invention are indicated in the dependent claims.

Thanks to the aforesaid characteristics, the engine designer has ample freedom to choose the positioning of the various components, with the advantage of minimising the size of the system, particularly in the vertical direction.

BRIEF DESCRIPTION OF THE DRAWINGS

The invention shall now be described with reference to the accompanying drawings, provided purely by way of non limiting example, in which.

DETAILED DESCRIPTION OF THE INVENTION

Figure 1:
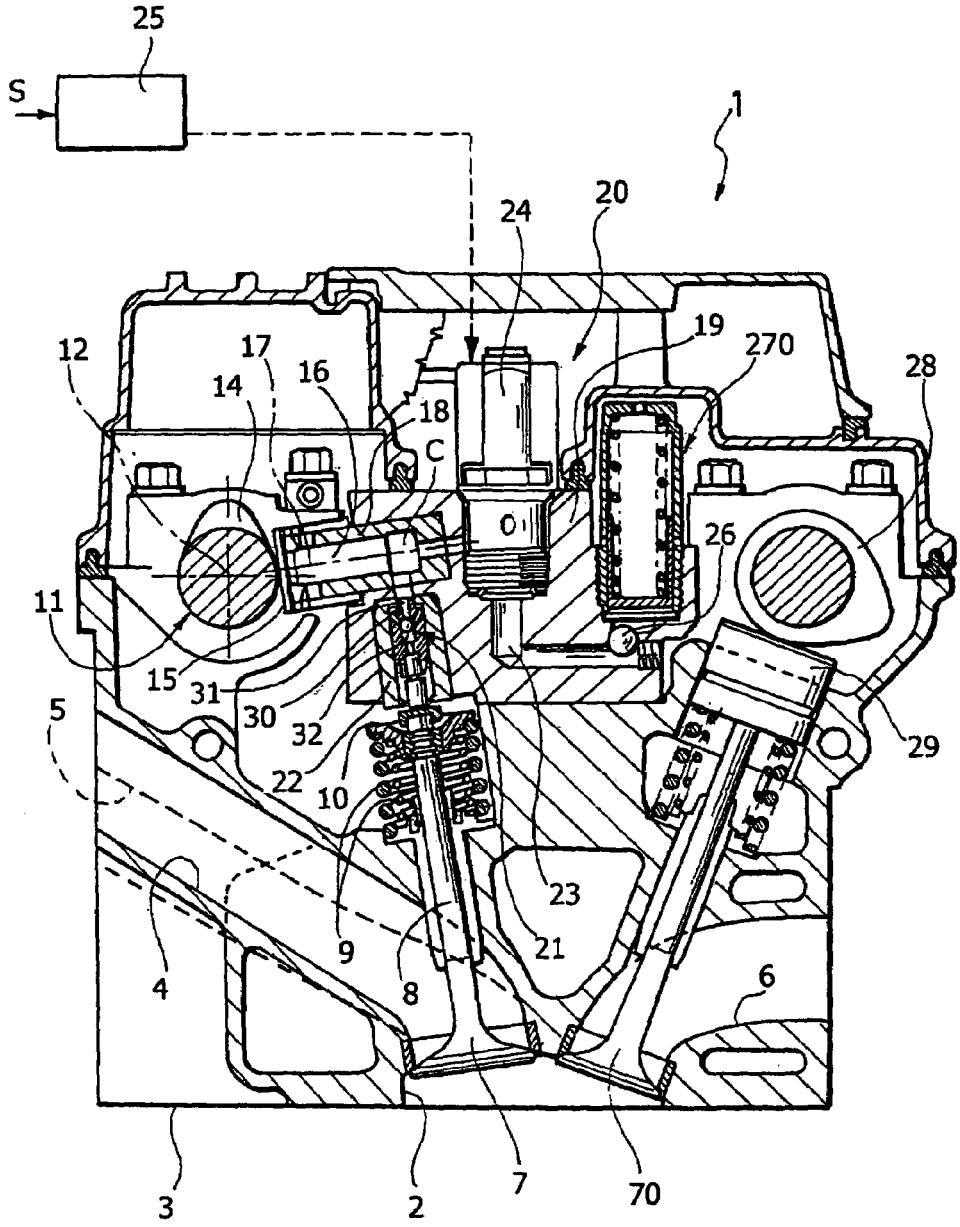
FIG. 1 is a section view of a prior art engine, of the type described for example in European Patent EP 0 803 642 B1 by the same Applicant, which is shown herein to illustrate the fundamental principles of a variable actuation system of the valves.

With reference to FIG. 1, the internal combustion engine described in the prior European patent application EP-A-0 803 642 by the same Applicant is a multi-cylinder engine, for instance an engine with four cylinders in line, comprising a cylinder head 1. The head 1 comprises, for each cylinder, a cavity 2 formed in the base surface 3 of the head 1, defining the combustion chamber, into which end two intake conduits 4, 5 and two exhaust conduits 6. The communication of the two intake conduits 4, 5 with the combustion chamber 2 is controlled by two intake valves 7, of the traditional mushroom type, each comprising a stem 8 slidably mounted in the body of the head 1. Each valve 7 is returned towards the closed position by springs 9 interposed between an inner surface of the head 1 and an end cup 10 of the valve. The opening of the intake valves 7 is controlled, in the manner described below, by a camshaft 11 rotatably mounted around an axis 12 within supports of the head 1, and comprising a plurality of cams 14 for actuating the valves 7.

Each cam 14 which controls an intake valve 7 co-operates with the washer 15 of a tappet 16 slidably mounted along an axis 17 which, in case of the example illustrated in the aforementioned prior document, was directed substantially at 90° relative to the axis of the valve 7. The tappet 16 is slidably mounted within a bushing 18 borne by a body 19 of a pre-assembled set 20 incorporating all the electrical and hydraulic devices associated with the operation of the intake valve, as described in detail below. The tappet valve 16 is able to transmit a bias to the stem 8 of the valve 7, in such a way as to cause the opening thereof against the action of the elastic means 9, by means of pressurised fluid (typically oil from the engine lubrication loop) present in a pressure chamber C, and a piston 21 mounted slidably in a cylindrical body constituted by a bushing 22 which is also borne by the body 19 of the subgroup 20. In the known solution shown in FIG. 1, the pressurised fluid chamber C associated to each intake valve 7 can be placed in communication with the exhaust channel 23 by means of a solenoid valve 24. The solenoid valve 24, which can be of any known type, suited to the function illustrated herein, is controlled by electronic control means, schematically designated by the number 25, according to signals S indicative of engine operating parameters, such as the position of the accelerator pedal and the number of engine revolutions per minute. When the solenoid valve 24 is opened, the chamber C comes in communication with the channel 23, so the pressurised fluid present in the chamber C flows into said channel and an uncoupling is obtained of the cam 14 and of the respective tappet 16 from the intake valve 7, which then rapidly returns to its closed position under the action of the return spring 9. By controlling communication between the chamber C and the outlet channel 23, it is therefore possible to vary at will the time and opening stroke of each intake valve 7.

The outlet channels 23 of the various solenoid valves 24 all end in a same longitudinal channel 26 communicating with pressure accumulators 27, only one whereof is visible in FIG. 1. All the tappets 16 with the associated bushings 18, the pistons 21 with the associated bushings 22, the solenoid valves 24 and the related channels 23, 26 are borne and formed in the aforesaid body 19 of the pre-assembled set 20, to the advantage of the rapidity and ease of assembly of the engine.

The exhaust valves 27 associated to each cylinder are controlled, in the embodiment illustrated in FIG. 1, in traditional fashion, by a respective cam shaft 28, by means of respective tappets 29, although in principle, both in the case of the prior document mentioned above, and in the case of the present invention, an application of the variable actuation system to command the exhaust valves is not excluded.

Also with reference to FIG. 1, the variable volume chamber defined inside the bushing 22 by the piston 21 (which in FIG. 1 is shown in its minimum volume condition, the piston 21 being in its upper top stroke end position) communicates with the pressurised fluid chamber C through an opening 30 obtained in an end wall of the bushing 22. Said opening 30 is engaged by an end nose 31 of the piston 21 in such a way as to obtain a hydraulic braking of the motion of the valve 7 in the closing phase, when the valve is near the closed position, since the oil present in the variable volume chamber is forced to flow into the pressurised fluid chamber C passing through the play existing between the end nose 31 and the wall of the opening 30 engaged thereby. In addition to the communication constituted by the opening 30, the pressurised fluid chamber C and the variable volume chamber of the piston 21 communicate with each other by means of internal passages formed in the body of the piston 21 and controlled by a check valve 32 which allows the passage of fluid only from the pressurised chamber C to the variable volume chamber of the piston 21.

During the normal operation of the prior art engine illustrated in FIG. 1, when the solenoid valve 24 excludes the communication of the pressurised fluid chamber C with the exhaust channel 23, the oil present in this chamber transmits the motion of the tappet 16 imparted by the cam 14 to the piston 21 that commands the opening of the valve 7. In the initial phase of the opening movement of the valve, the fluid coming from the chamber C reaches the variable volume chamber of the piston 21 passing through an axial hole drilled in the nose 30, the check valve 32 and additional passages which place in communication the inner cavity of the piston 21, which has tubular shape, with the variable volume chamber. After a first displacement of the piston 21, the nose 31 comes out of the opening 30, so the fluid coming from the chamber C can pass directly into the variable volume chamber through the opening 30, which is now free. In the inverse movement of closure of the valve, as stated, during the final phase the nose 31 enters into the opening 30 causing the hydraulic braking of the valve, to prevent any impacts of the body of the valve against its seat.

Figure 2:
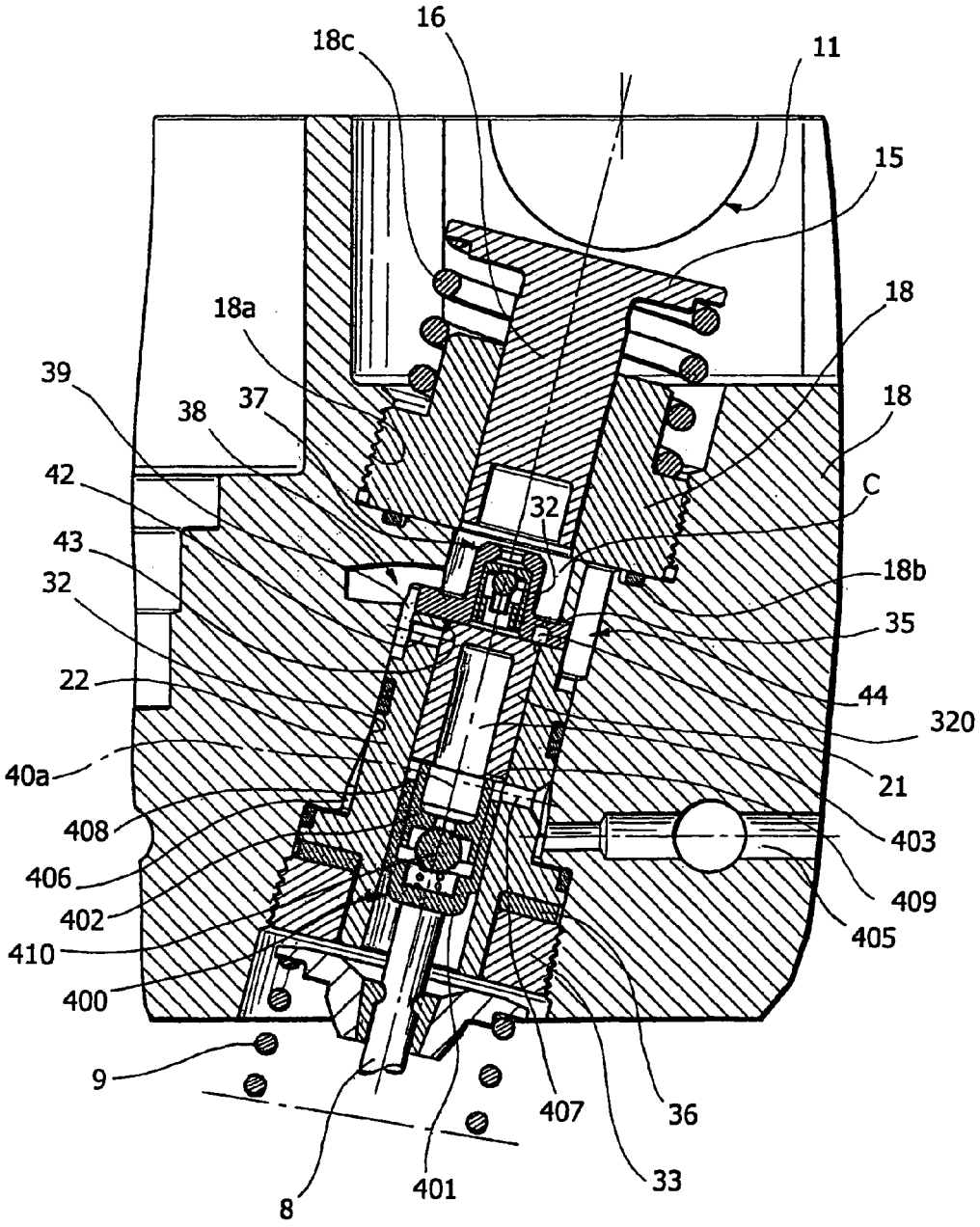
FIG. 2 is a section view in enlarged scale of an auxiliary hydraulic tappet associated with an intake valve of an engine of a type similar to that of FIG. 1, as previously proposed in the European Patent application EP 1 344 900 by the Applicant.

FIG. 2 shows the device described above in the modified form which was proposed in the previous European Patent application EP 0 1 344 900 by the same Applicant.

In FIG. 2, the parts in common with FIG. 1 are designated by the same reference number.

A first evident difference of the device of FIG. 2 with respect to that of FIG. 1 is that in the case of FIG. 2, the tappet 16, the piston 21 and the stem 8 of the valve are mutually aligned along an axis 40. This difference does not fall within the scope the invention, as it is already contemplated in the prior art. Similarly, the invention would also apply to the case in which the axes of the tappet 16 and of the stem 8 were to form an angle between them.

Similarly to the solution of FIG. 1, the tappet 16, with the related washer 15 which co-operates with the cam of the camshaft 11 is slidably mounted in a bushing 18. In the case of FIG. 2, the bushing 18 is screwed into a threaded cylindrical seat 18*a* obtained in the metal body 19 of the pre-assembled set 20. A sealing gasket 18*b* is interposed between the bottom wall of the bushing 18 and the bottom wall of the seat 18*a*. A spring 18*c* returns the washer 15 in contact with the cam of the camshaft 11.

In the case of FIG. 2 also, as in FIG. 1, the piston 21 is slidably in a bushing 22 which is received in a cylindrical cavity 32 obtained in the metallic body 19, with the interposition of sealing gaskets. The bushing 22 is held in the condition mounted by an end threaded ring nut of the cavity 32 and which presses the body of the bushing 22 against an abutment surface 35 of the cavity 32. Between the locking ring nut 33 and the flange 34 is interposed a Belleville washer 36 to assure a controlled axial load to compensate for the differential thermal expansions between the different materials constituting the body 19 and the bushing 22.

The main difference of the prior art solution shown in FIG. 2 and the one, also known, of FIG. 1 is that in this case the check valve 32 which allows the passage of pressurised fluid from the chamber C to the chamber of the piston 21 is not borne by the piston 21 but rather by a separate element 37 which is fixed relative to the body 19 and it superiorly closes the cavity of the bushing 22 within which is slidably mounted the piston 21. Moreover, the piston 21 does not have the complicated conformation of FIG. 1, with the end nose 31, but it is shaped as a simple cup-like cylindrical element, with a bottom wall facing the variable volume chamber which receives pressurised fluid from the chamber C through the check valve 32.

The element 37 is constituted by an annular plate which is locked in position between the abutment surface 35 and the end surface of the bushing 22, as a result of the tightening of the locking ring nut 33. The annular plate has a central cylindrical projection which serves as a container for the check valve 32 and which has an upper central hole for the passage of the fluid. In the case of FIG. 2 as well, the chamber C and the variable volume chamber delimited by the piston 21 communicate with each other, as well as through the check valve 32, through an additional passage, constituted by a lateral cavity 38 obtained in the body 19, a peripheral cavity 39 defined by a flattening of the outer surface of the bushing 22, and by an opening (not showing in FIG. 2) of greater size and a hole 42 of smaller size obtained radially in the wall of the bushing 22. These openings are shaped and mutually arranged in such a way as to achieve operation with hydraulic brake in the final closing phase of the valve, for when the piston 21 has obstructed the opening of greater size, the hole 42 remains free, which intercepts a peripheral end throat 43 defined by a circumferential end groove of the piston 21. To assure that the aforesaid two openings correctly intercept the fixed passage 38, the bushing 34 must be mounted in a precise angular position, which is assured by an axial pin 44. This solution is preferred with respect to the arrangement of a circumferential throat on the outer surface of the bushing 22, for this would entail an increase in the oil volumes in play, with consequent drawbacks in operation. A calibrated hole 320 is also provided in the element 37, which directly places the annular chamber defined by the throat 43 in communication with the chamber C. Said hole 320 assures correct operation at low temperature, when the fluid (engine lubrication oil) is very viscous.

In operation, when the valve needs to be opened, pressurised oil, bias by the tappet 16, flows from the chamber C to the chamber of the piston 21 through the check valve 32. As soon as the piston 21 has moved away from its upper end stop position, the oil can then flow directly into the variable volume chamber through the passage 38 and the two aforesaid openings (the larger one and the smaller one 42), bypassing the check valve 32. In the return movement, when the valve is near its closed position, the piston 21 intercepts first the large opening and then the opening 42 determining the hydraulic braking. A calibrated hole can also be provided in the wall of the element 37 to reduce the braking effect at low temperatures, when the viscosity of the wall would cause excessive slowing in the movement of the valve.

As is readily apparent, the main different with respect to the solution shown in FIG. 1 is that the operations for fabricating the piston 21 are much simpler, since said piston has a far less complicated conformation than the one contemplated in the prior art. The solution according to the invention also allows to reduce the oil volume in the chamber associated with the piston 21, which allows to obtain a regular closing movement of the valve, without hydraulic bounces, a reduction in the time required for closing, a regular operation of the hydraulic tappet, without pumping, a reduction in impulsive force in the springs of the engine valves and reduction in hydraulic noise.

An additional characteristic of the prior art solution shown in FIG. 2 is the provision of a hydraulic tappet between the piston 21 and the stem 8 of the valve. The tappet 400 comprises two concentric slidable bushings 401, 402. The inner bushing 402 defines with the inner cavity of the piston 21 a chamber 403 which is fed a pressurised fluid through passages 405, 406 in the body 19, a hole 407 in the bushing 22 and passages 408, 409 in the bushing 403 and in the piston 21.

A check valve 410 controls a central hole in a frontal wall borne by the bushing 402.

Figure 3:
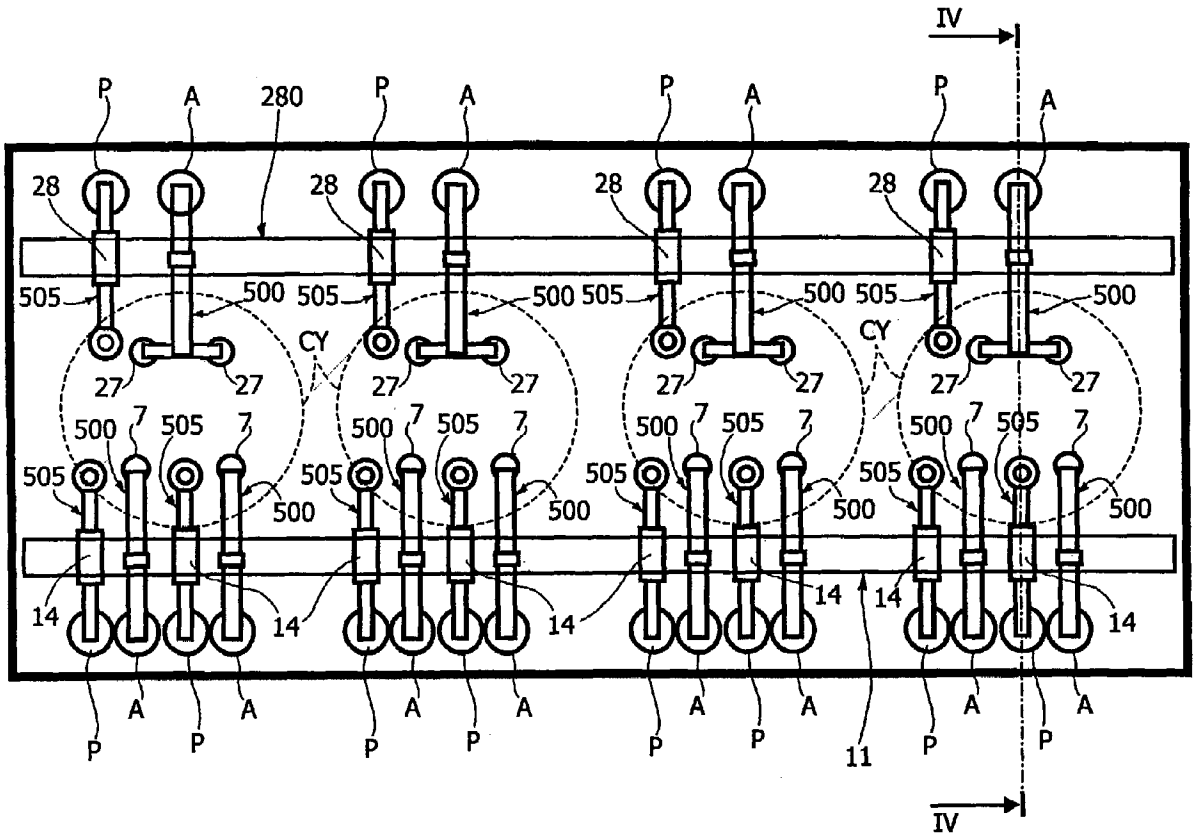
FIG. 3 is a schematic plan view of the valve actuation system in an engine with four in line cylinders according to the invention.
Figure 4:
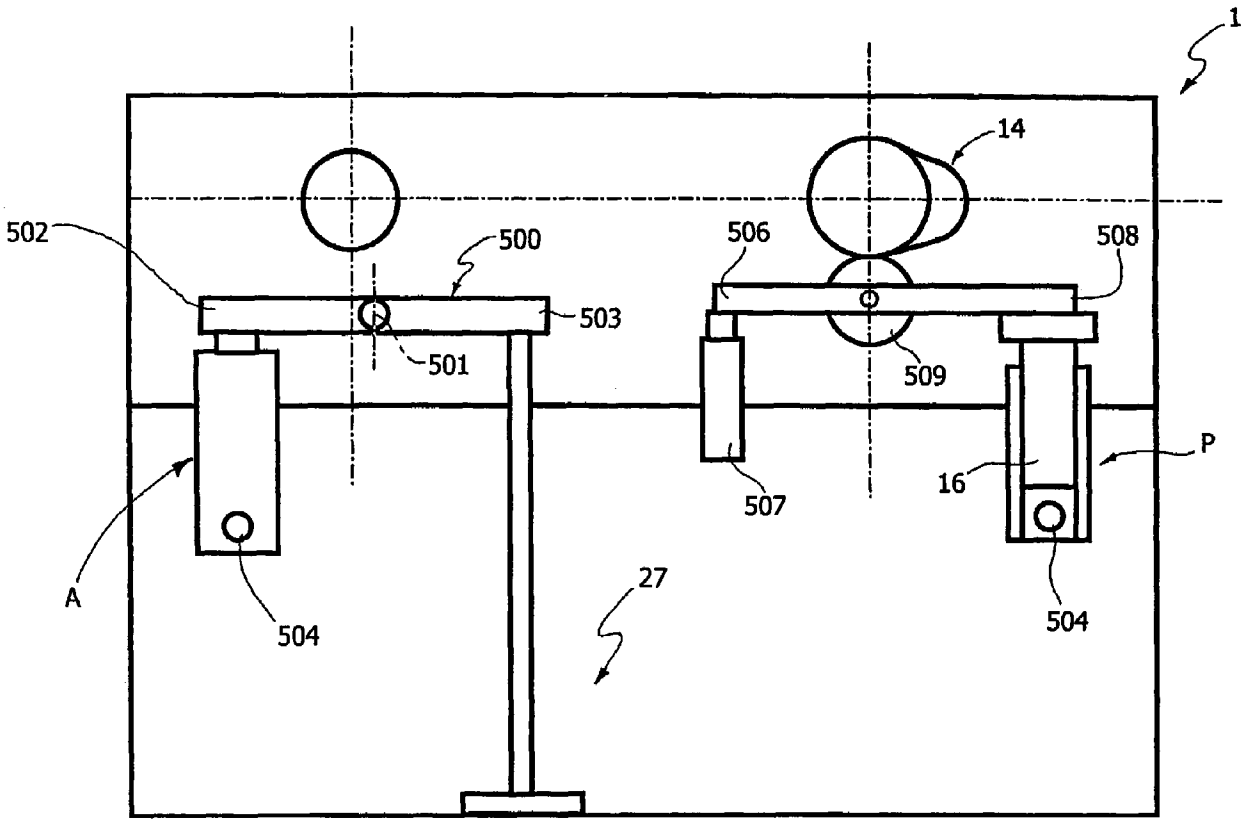
FIG. 4 is a schematic section view according to the line IV—IV of FIG. 3.

With reference now to FIGS. 3, 4, therein is illustrated a four cylinder engine according to the present invention. The number 1 generically designates the engine cylinder heat, seen in plan view in FIG. 3. The cylinders are schematically indicated with dashed lines and identified by the reference CY. In the illustrated embodiment, each cylinder of the engine is provided with two intake valves 7 and with two exhaust valves 27, schematically illustrated in FIG. 3. In FIG. 3, the reference A designates each of the hydraulic actuator units that actuate the intake valves 7. Each actuator unit A can, for example, be constituted in accordance with the solution shown in FIG. 2. The actuator unit A comprises mainly the actuating piston 21 mounted slidably in the respective guide bushing 22 and it may comprise the auxiliary hydraulic tappet 400 associated with the piston 21.

A fundamental characteristic of the present invention is that the piston 21 of each actuator unit A is not positioned with its axis in line with the stem 8 of the respective intake valve 7, as in prior art solution shown in FIG. 2, but rather it actuates the respective intake valve through a mechanical transmission, specifically through a rocker arm 500. As shown also in FIG. 4, which illustrates a wholly similar rocker 500, which is used, as shall be described below, to actuate the exhaust valves 27, each rocker arm 500 is mounted oscillating in its own intermediate area on the body of the engine, specifically on the body of the head around an articulation axis 501 and it has opposite ends 502, 503 co-operating respectively with the actuator A and with a valve actuated thereby.

Adoption of the aforesaid characteristic allows considerably to reduce the dimensions of the engine according to the invention, particularly in the vertical direction, so much so that it is substantially similar, from this viewpoint, to a traditional engine lacking hydraulic valve control. This advantage was not present instead in the prior solutions of engines with variable actuation valve, e.g. in the case of the engines of FIGS. 1, 2, where each variable actuation valve was controlled by a hydraulic actuator unit that was aligned with the valve axis.

Continuing with the description of the control system of the intake valves 7, the variable volume chamber of each actuator unit A is hydraulically connected to the pressurised chamber C associated with a respective pumping set P. Said hydraulic communication is shown schematically in FIG. 3 by short connecting conduits between each actuator A and each pumping set P. Each pumping set can be of the type shown, for example, in FIG. 2, with a pumping piston 16 which is controlled by a respective cam 14 of the camshaft 11. However, as FIG. 4 clearly shown, the cam 14 controls the piston 16 of each pumping set P through the rocker arm 505. In the case of the illustrated example, the rocker arm 505 is mounted oscillating at one of its ends 506 on a support 507 fastened to the engine body, specifically to the body of the cylinder head, and it has its opposite end 508 co-operating with the pumping piston 16. In its intermediate area, the rocker arm 505 is provided with a freely rotatable roller 509 which follows the cam 14.

Also with reference to FIG. 3, in the case of the preferred embodiment illustrated therein, the two exhaust valves 27 of each cylinder CY are controlled by one end of a single rocker arm 500 which is mounted oscillating in its intermediate area around an axis 501 on the body of the engine and which has the opposite end 502 (as clearly shown in FIG. 4) co-operating with an actuator unit A of the type illustrated, for example, in FIG. 2. The actuator unit is in hydraulic connection through a passage 504, shown schematically in the drawings, with the pumping set P which is controlled by a cam 28 of a second camshaft 280 that controls the exhaust valves.

As shown, thanks to the arrangement illustrated above, all the elements of the hydraulic control system for the intake and exhaust valves can be positioned during the design phase without thereby entailing large engine dimensions, especially in the vertical direction.

As is readily apparent from the above description and from FIGS. 3, 4, the rocker arm 500 which controls each intake valve and the rocker arm 505 associated with the cam which controls said intake valve are arranged in planes orthogonal to the axis of the camshaft, which are distanced from each other. This means that the axis of each intake valve 7 and the axis of the pumping set P that controls said intake valve are arranged in planes that are orthogonal to the axis of the camshaft and distanced from each other. Similarly, the orthogonal plane to the axis of the camshaft 280 in which is positioned the rocker arm 500 which controls the exhaust valves 27 is distanced from the plane, orthogonal to the axis of the camshaft 280, in which are positioned the respective pumping set P, the respective rocker arm 505 and the respective cam 28.

Obviously, as shown in FIG. 2, to each actuator unit A can be associated an auxiliary hydraulic tappet 400 which is operatively interposed between the actuator unit A and the respective rocker arm 500.

Naturally, without altering the principle of the invention, the construction details and the embodiments may be widely varied relative to what is described and illustrated purely by way of example herein, without thereby departing from the scope of the present invention.

What is claimed is:

1. A multi-cylinder internal combustion engine, comprising:

at least one intake valve and at least one exhaust valve for each cylinder, each provided with respective elastic return means which bias the valve towards a closed position, to control respective intake and exhaust conduits, at least a camshaft, for actuating the intake valves and the exhaust valves of the engine cylinders by means of respective tappets, in which at least each intake valve has variable actuation, being actuated by the respective tappet, against the action of the aforesaid elastic return means, by the interposition of hydraulic means including a pressurised fluid chamber, into which projects a pumping piston connected to the tappet of the intake valve, said pressurised fluid chamber being able to be connected by means of a solenoid valve with an exhaust channel, in order to uncouple the variable actuation valve from the respective tappet and cause the rapid closure of the valve by effect of the respective elastic return means, electronic control means for controlling each solenoid valve in such a way as to vary the time and travel of opening of the variable actuation valve as a function of one or more operative parameters of the engine, in which the aforesaid hydraulic means further comprise an actuator unit for the variable actuation valve, which includes:

an actuating piston slidably mounted within a guide bushing, said actuating piston facing a variable volume chamber communicating with the pressurised fluid chamber both through first communication means controlled by a check valve which allows only the passage of the fluid from the pressurised fluid chamber to the variable volume chamber, and through second communication means which allow the passage between the two chambers in both directions, and hydraulic braking means able to cause a narrowing of said second communication means in the final phase of closure of the engine valve, wherein said actuating piston which is a part of said actuator unit of the variable actuation valve has its axis distanced from the axis of the valve and controls said valve through a mechanical transmission.

2. Engine as claimed in claim 1, wherein said mechanical transmission is constituted by a rocker arm.

3. Engine as claimed in claim 2, wherein the axis of the pumping piston associated with said actuator unit of the variable actuation valve, and the axis of said valve lie in respective planes, orthogonal to the axis of the cam shaft, which are distanced from each other.

4. Engine as claimed in claim 3, wherein said pumping piston is controlled by the respective cam of the camshaft through a rocker arm.

5. Engine as claimed in claim 4, wherein said rocker arm controls the pumping piston has an end mounted able to oscillate on the body of the engine, the opposite end co-operating with the pumping piston and an intermediate area co-operating with respective cam of the camshaft.

6. Engine as claimed in claim 2, wherein an actuator unit with a respective rocker arm is provided for each intake valve.

7. Engine as claimed in claim 6, wherein the exhaust valves of the engine also have variable actuation.

8. Engine as claimed in claim 7, wherein said engine has two exhaust valves for each cylinder which are controlled by means of a single rocker arm by a single actuator unit.

9. Engine as claimed in claim 8, wherein said rocker arm is mounted able to oscillate on the body of the engine and has two opposite ends co-operating respectively with the actuating piston and with the stem of the valve.

10. Engine as claimed in claim 8, wherein said engine has two intake valves per cylinder, which are controlled by means of respective rocker arms by respective actuator units.

11. Engine as claimed in claim 2, wherein between the actuator unit and the aforesaid rocker arm is operatively interposed an auxiliary hydraulic tappet.

* * * * *